United States Patent [19]

Schumacker et al.

[11] 4,355,736

[45] Oct. 26, 1982

[54] DEVICE FOR DISPENSING A LIQUID OR A PASTE IN A FINELY DIVIDED MANNER

[76] Inventors: Henri J. J. Schumacker; Terese F. Schumacker, both of 121A Ave. Van Becelaere, B-1170 Brussels, Belgium

[21] Appl. No.: 239,925

[22] Filed: Mar. 3, 1981

Related U.S. Application Data

[63] Continuation of Ser. No. 11,583, Feb. 12, 1979, abandoned.

[30] Foreign Application Priority Data

Mar. 1, 1978 [BE] Belgium ..... 185581

[51] Int. Cl.[3] ..... B67D 5/54

[52] U.S. Cl. ..... 222/80; 222/386.5; 222/389

[58] Field of Search ..... 222/386, 386.5, 389, 222/80, 147

[56] References Cited

U.S. PATENT DOCUMENTS 3,273,762 9/1966 O'Neill ..... 222/389

3,381,863 5/1968 Towns ..... 222/386.5

3,915,352 10/1975 Scheindel ..... 222/389

*Primary Examiner*—Joseph J. Rolla

*Assistant Examiner*—Frederick R. Handren

*Attorney, Agent, or Firm*—Sughrue, Mion, Zinn, Macpeak and Seas

[57] ABSTRACT

A device for dispensing a liquid or a paste in a finely divided manner as an aerosol comprises a tubular rigid container with valve means allowing the ejection of the liquid or the paste in the container through an outlet. The container has two inner chambers, one of which contains a gas under pressure, whereas the other contains the liquid or paste to be dispensed, the chambers being separated from each other by a sliding element which is tightly in contact with the inner wall of the container. The sliding element consists of a deep cup, the open part of which is directed towards the chamber containing the compressed gas and which is provided at its free edge, with a guiding element and, on its periphery, with at least one sealing peripheral projection and with a peripheral boss or flange acting as a scraper for removing the bruises or dents in the inner wall of the tubular container.

2 Claims, 6 Drawing Figures

DEVICE FOR DISPENSING A LIQUID OR A PASTE IN A FINELY DIVIDED MANNER

This is a continuation of application Ser. No. 11,583, filed Feb. 12, 1979, now abandoned.

PRIOR ART

In known devices of this type, the liquid or paste to be distributed is mixed with the gas under pressure and is ejected together with said gas through the distributing valve. This gas which is a propelling gas is frequently a fluorinated hydrocarbon, such as freon, or a lower aliphatic hydrocarbon, such as propane or butane. A drawback of these gases is that they are inflammable and/or toxic.

In other known devices, the propelling gas consists of compressed air and the sliding element is equipped with a sealing joint or gasket separating the liquid-or paste-containing chamber from the gas-containing chamber. A drawback of these known devices is that the sliding element or piston consists of a thin disc which has a tendency to move in a direction which is not coaxial to the longitudinal axis of the tubular container under the influence of the compressed gas, when the distributing valve is opened, for ejecting the liquid or paste from the liquid- or paste-containing chamber.

Another known device of the above described type contains a cup-shaped sliding element which is open towards the chamber containing the compressed gas, a sealing joint being formed between said cup and the inner wall of the container by a layer of the liquid or paste to be distributed. This device has never become used in the practice since it is not correctly guided coaxially in the container and causes leakage of the liquid or paste into the gas chamber.

SUMMARY OF THE INVENTION

It is an object of this invention to avoid the drawbacks of the known devices, i.e. to provide a device of the above described type, wherein the liquid-chamber and the gas-chamber are tightly separated from each other, whereas the sliding element is guided so as to permanently be maintained coaxial to the longitudinal axis of the tubular container.

This invention relates to a device comprising a substantially tubular rigid container with valve means allowing the ejection of the liquid or the paste contained in the container through an outlet, the container having two inner chambers, one of which contains a gas under pressure, whereas the other contains the liquid or paste to be dispensed or distributed, the chambers being separated from each other by a sliding element which is tightly in contact with the inner wall of the container, the sliding element consisting of a deep cup, the open part of which is directed towards the chamber containing the compressed gas and which is provided, preferably at its free edge, with a guiding element and, on its periphery, with at least one sealing peripheral projection and possibly with a peripheral boss or flange acting as a scraper for removing the bruises or dents in the inner wall of the tubular container.

According to an important feature of the invention, the cup used as sliding element separating the two chambers from each other, has a height which is at least equal to its diameter. This means that the cup, instead of consisting of a relatively thin disc possibly with a small flange, comprises from its bottom a skirt having a height which is sufficient for causing the sliding element to remain coaxial to the axis of the container during its movement therein, while being maintained tightly in contact with the inner wall of the container, due to the combined effect of the sealing peripheral projection(s) and of the guiding element, as well as of the optional scraping element.

The scraping peripheral element or projection which is preferably located in the vicinity of the closed bottom of cup-shaped sliding element, acts mainly as scraper of the inner wall of the container, so as to remove the bruises or dents therefrom, whereby the cup-shaped sliding element can easily slide along said inner wall, under the pressure of the compressed gas, when the distributing or dispensing valve is opened.

In a preferred embodiment, the cup-shaped sliding element has a scraping flange near its closed bottom, two peripheral sealing projections spaced from each other on its outer surface and a guiding element at its free end opposed said bottom. A flexible ring made, for example, of foam may be located between the two peripheral sealing projections.

According to another feature of the invention, at least a part of the outer surface of the closed bottom of the axially movable cup is inclined towards the axis of the cup, the inclined part having, for example, the shape of a truncated cone which flares out towards the edge of the cup extending near the inner wall of the container.

The purpose of the inclined or truncated part of the bottom of the cup-shaped sliding element is to collect the liquid or paste to be distributed, within a small volume, when a small amount of liquid is left in the container, so as to enable a complete ejection of said liquid through the valve carried by the container.

On the other hand, in order to allow a disposal and/or recovery of the empty container, without any danger of explosion of this container, for example, during the treatment of rubbish by crushing or incineration, even if it contains an uninflammable or non toxic gas, the dispensing valve is provided, in accordance with this invention, with a tubular bevelled tip or needle which allows the ejection if the gas through the distributing valve, such ejection being permitted by the fact that said bevelled tip or needle is caused to pierce the closed bottom of the cup.

The bottom of the cup-shaped sliding element has a shape which corresponds to that of the upper part of the container, so that a minimum amount of liquid or paste can remain in said container, when said bottom comes into contact with said upper part.

Due to the fact that the sliding element has the shape of a deep cup, the propulsive force of the compressed gas is much more important than when the sliding element simply consists of a relatively thin rigid disc.

Other features and details of the invention will appear in the following description of a few purely illustrative embodiments of the device according to this invention.

BRIEF DESCRIPTION OF THE DRAWINGS

In this description, reference is made to the attached drawings, in which.

DETAILED DESCRIPTION OF THE PREFERRED EMBODIMENTS

In these various figures, the same references designate identical or similar elements.

Figure 1:
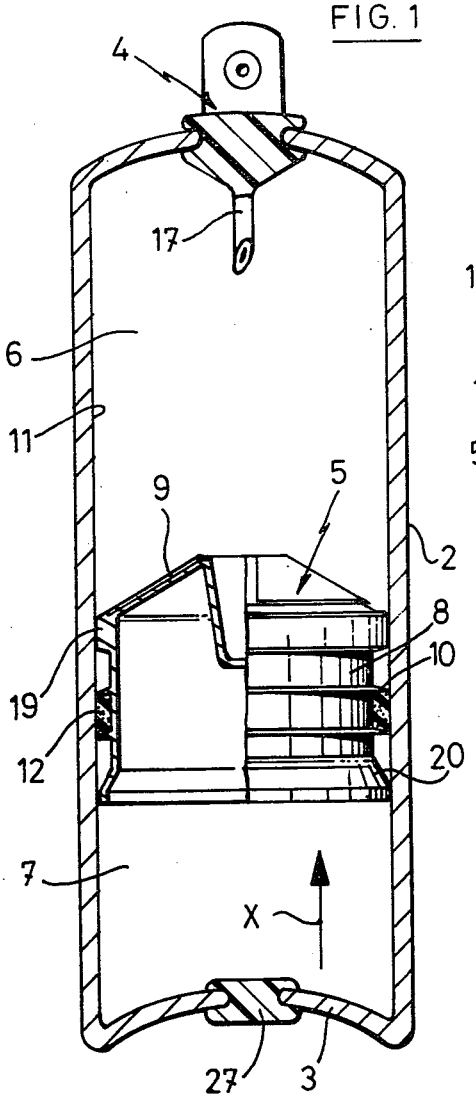
FIG. 1 is a side view, partly in section and partly broken, of a first embodiment of a device according to this invention.
Figure 5:
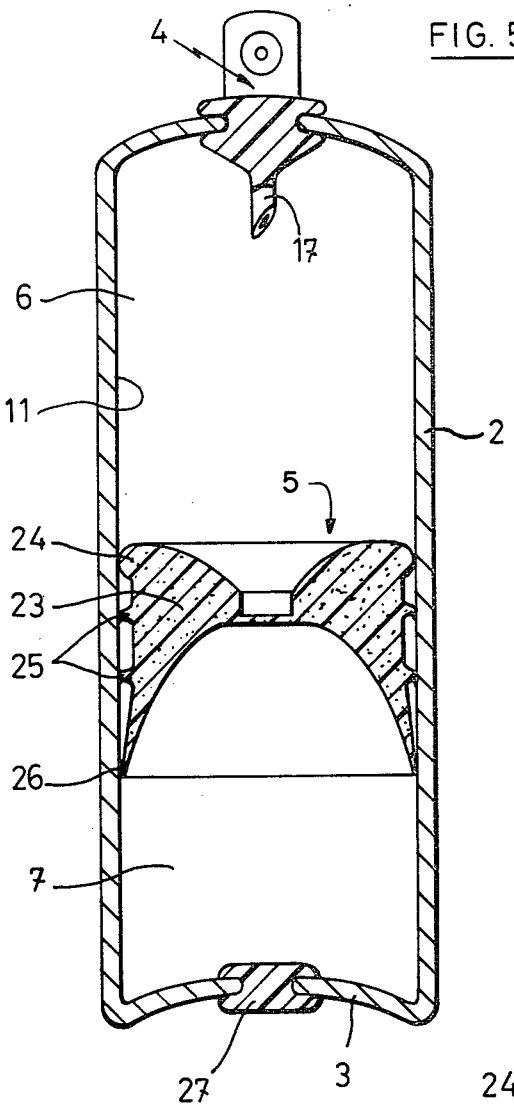
FIG. 5 is a side view, partly in section, of another embodiment of a device according to this invention.

The various embodiments of the device to be used for dispensing a liquid or a paste in a finely divided manner, which are shown in FIGS. 1 and 5 comprise a rigid container 2 having a cylindrical shape, which may be made of metal, such as steel or aluminium, plastic or glass. At the upper end of said container, the bottom of which is, for example, concave, is fixed a valve generally indicated by reference 4. The container is divided in two chambers 6 and 7 by a sliding element 5. Chamber 6 is intended to contain a liquid or a paste under pressure, whereas chamber 7 is adapted to contain a compressed gas, preferably compressed air, for example under a pressure of 6 to 9 kg/cm$^2$, the use of compressed air, instead of an inflammable and/or toxic gas, being advantageous for the protection of the environment.

In the embodiment of the device according to this invention represented in FIG. 1, the sliding element 5 has the shape of an inverted deep cup, i.e. a cup having a skirt 8 extending downwardly and having a closed upper bottom 9 directed towards the liquid- or paste-containing chamber 6. Two peripheral projections 10 cause a correct sealing of the sliding element 5 along the internal wall 11 of the container 2; in other words, these two projections avoid the passage of the compressed gas from chamber 7 into chamber 6 during the sliding movement of the sliding element 5 along the inner surface 11 of the container. An elastic or flexible ring made of foam may be arranged in the annular space 13 defined by the two peripheral sealing projections or flanges 10, the skirt 8 and the internal wall 11 of the container 2.

The surface of the bottom 9 of the cup 5, which is directed towards chamber 6, has the shape of a truncated cone, as shown by reference 14 in FIG. 1, the small flat surface 15 of a cavity or recess 16 provided in the central part of the bottom 9 being capable of being pierced by a bevelled end of an outlet 17 of the distributing valve 6, said end projecting slightly into the container 2, when the bottom of the sliding element 5 which is moved in the direction of arrow X, comes into contact with the bevelled end of outlet 17.

In the truncated part 14 of bottom 9 of the cup-shaped sliding element 5 extend radial grooves 18 which are inclined towards said cavity, so that the small volume of liquid or paste remaining in the container 2, when said bottom 9 reaches the vicinity of the free end of outlet 17 of the valve 6, can still be ejected from the container. The compressed air remaining in chamber 7 is vented from the exhausted or empty container 2 when the free end of outlet 17 pierces the bottom of the cup-shaped sliding element 5, whereby any accidental danger of explosion of the container is avoided, so that the empty container can be thrown away or recovered without danger.

Figure 2:
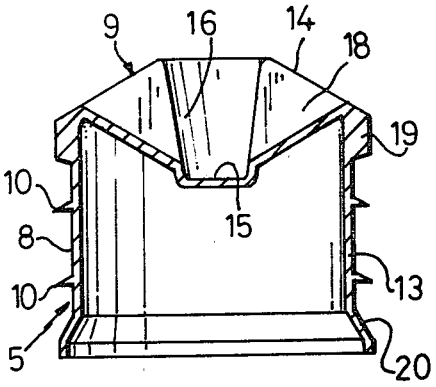
FIG. 2 is a vertical section of the cup-shaped sliding element shown in FIG. 1.
Figure 3:
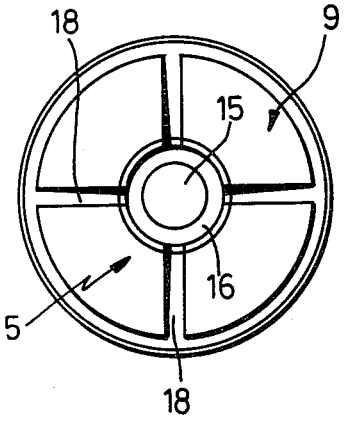
FIG. 3 is a front view from the above side of the sliding element represented in FIG. 1.

The cup-shaped sliding element 5 represented in FIGS. 2 and 3, which has a height at least equal to its diameter has, on the periphery of the bottom 9 thereof, an annular projecting flange or shoulder 19 acting as a scraper for removing the bruises or dents of the inner surface 11 of the container (such inner surface being frequently not smooth), two peripheral sealing projections 10 and a lower guiding edge 20 having a truncated part connected to a lower cylindrical part, the latter having an outer diameter corresponding to the inner diameter of the container 2.

Figure 4:
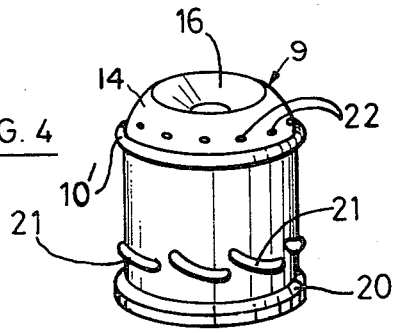
FIG. 4 is a perspective view of another embodiment of the cup-shaped sliding element according to this invention.

FIG. 4 shows another embodiment of the cup-shaped sliding element 5 having a rigid bottom 9, said sliding element differing only from the one shown in FIGS. 2 and 3 by the fact that the annular flange 19 is replaced by a series of projections 21 which may possibly be inclined (as shown in FIG. 4), whereas the sealing element comprises in a peripheral flange 10', for example made of rubber or a similar material.

Moreover, the truncated part 14 of the bottom 9 of cup 5 comprises holes 22 connecting the periphery of said truncated part to the bottom of cavity 16.

Figure 6:
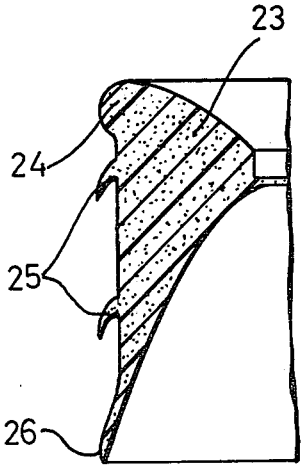
FIG. 6 is a transverse section of a portion (half) of the cup-shaped sliding element shown in the device represented in FIG. 5.

The device according to the invention, represented in FIG. 5 differs from the one shown in FIGS. 1 to 3 by the shape of the sliding element 5 (see also FIG. 6) which has a bottom having the form of an inverted truncated cone 23 provided, at its periphery, with an annular scraping flange 24, two sealing projections 25 and a lower elongated guiding lip 26.

It is obvious that more than two sealing elements 25 may be used.

The container 2 of the device according to this invention may be equipped with a security valve 27 at its bottom.

What is claimed is:

1. A device for dispensing a liquid or a paste in a finely divided form, comprising: a substantially tubular closed rigid container (2), valve means (4) mounted in one end of the container for ejecting liquid or paste therein through an outlet tube (17) connected to the valve means, the container having two superimposed chambers separated from each other by a piston (5) adapted to slide along the inner wall (11) of the container when the valve means is operated, a lower one (7) of said chambers containing a gas under pressure and an upper one (6) of said chambers containing a liquid or paste to be dispensed, the piston having the shape of an inverted deep cup open toward the gas containing chamber, and having a rigid bottom (9) facing the valve means and a flexible cylindrical thin side wall (8), a rigid annular scraper flange (19) integral with said side wall and extending from the peripheral edge of said bottom toward the free end of and around said side wall to render said side wall stiff around its portion connected to said bottom for removing bulges or dents in the inner wall of the container, a truncated guide cone (20) flaring outwardly toward said inner wall at the free end of the side wall, at least one intermediate, outwardly extending sealing projection (10) carried by said side wall in the space between said scraper flange and said truncated guide cone, said piston side wall being spaced from the container inner wall and contacting same only through the scraper flange, the sealing projection and the truncated guide cone, the rigid bottom of the piston having an upper surface directed toward the liquid or paste containing chamber and having the shape of a truncated cone (14) flaring outwardly toward the inner wall of the container, a central cavity (16) defined in the bottom of the piston and open towards the liquid or paste containing chamber, and a membrane (15) embodied in the bottom of said cavity adapted to be pierced by the outlet tube when the piston has reached an upper limit of its travel in the container to vent any pressurized gas remaining in said lower chamber.

2. A device according to claim 1, further comprising radial channels (18) connecting the peripheral edge of the bottom of the piston to the central cavity thereof to maximize the expulsion of the liquid or paste within the upper chamber.

* * * * *